US011081774B1

(12) United States Patent
Lee et al.

(10) Patent No.: US 11,081,774 B1
(45) Date of Patent: Aug. 3, 2021

(54) NEGATIVE COUPLING STRUCTURE APPLIED IN A DIELECTRIC WAVEGUIDE FILTER

(71) Applicant: Universal Microwave Technology, Inc., Keelung (TW)

(72) Inventors: Chien-Chih Lee, Taipei (TW); Yu-Fu Chen, Taipei (TW); Hsueh-Han Chen, New Taipei (TW)

( * ) Notice: Subject to any disclaimer, the term of this patent is extended or adjusted under 35 U.S.C. 154(b) by 0 days.

(21) Appl. No.: 16/828,959

(22) Filed: Mar. 25, 2020

(51) Int. Cl.
*H01P 5/12* (2006.01)
*H01P 1/20* (2006.01)

(52) U.S. Cl.
CPC ..... *H01P 5/12* (2013.01); *H01P 1/2002* (2013.01)

(58) Field of Classification Search
CPC ..... H01P 5/12; H01P 1/2002
USPC ..... 333/260
See application file for complete search history.

(56) References Cited

U.S. PATENT DOCUMENTS 9,998,163 B2 * 6/2018 Yuan ..... H01P 7/10

FOREIGN PATENT DOCUMENTS

CN 111384556 A * 7/2020
CN 111403862 A * 7/2020
CN 111403869 A * 7/2020

* cited by examiner

*Primary Examiner* — Robert J Pascal
*Assistant Examiner* — Kimberly E Glenn

(57) ABSTRACT

A negative coupling structure applied in a dielectric waveguide filter includes an elongated blind hole formed on a first surface of a dielectric body for building the negative coupling structure, and tuning holes formed on the first surface or a second surface of the dielectric body. A first coupling portion configured to be corresponsive to a bottom wall of the elongated blind hole, a second coupling portion configured to be corresponsive to a side wall of the elongated blind hole, and a common coupling portion connected between the bottom wall and the side wall are provided to define a negative coupling structure in the dielectric body, so as to provide both capacitive coupling and inductive coupling and a negative coupling and achieve the effects of reducing the weight and volume of the dielectric waveguide filter and providing good performance, simple structure and easy manufacture.

7 Claims, 8 Drawing Sheets

NEGATIVE COUPLING STRUCTURE APPLIED IN A DIELECTRIC WAVEGUIDE FILTER

BACKGROUND OF THE INVENTION

Field of the Invention

The present invention relates to a filter structure with both capacitive coupling and inductive coupling used in the field of communication, in particular to a negative coupling structure applied in a dielectric waveguide filter.

Description of Related Art

In general, a mobile communication base station mainly uses related processing units to complete the convention between baseband signals and radio frequency signals. An antenna of the mobile communication base station serves as a conversion medium for the radiation of electromagnetic waves propagating in space and signals transmitted in circuits. Therefore, signals can be transmitted by radiation to the space through the antenna, or received by receiving the electromagnetic waves in space.

In a radio frequency processing unit of the mobile communication base station, a filter coupled to the antenna is used to assist the base station to filter unnecessary bands, so as to receive or transmit specific electromagnetic waves. In the third-generation and fourth-generation (3G/4G) mobile communication technology, the filter is mainly configured with a metal coaxial cavity, wherein transmissions and oscillation inside the cavity can eliminate the unnecessary bands, but the filters of this type have a relatively large volume, so that such filters are not suitable for the fifth-generation mobile communication technology (5G) that needs to build the mobile communication base stations widely.

In the dielectric waveguide filter, resonance occurs in a dielectric material (such as a ceramic material) instead of the metal coaxial cavity, so that the volume of the filter cannot be reduced. However, the interior of the dielectric waveguide filter is filled with the solid dielectric material. Therefore, adjustments are not as flexible as those of the filters made of the metal coaxial cavity, and it is difficult to have transmission zero of the coupling inside the cavity of a miniaturized dielectric waveguide filter or achieve a negative coupling.

SUMMARY OF THE INVENTION

It is a primary objective of the present invention to provide a dielectric waveguide filter with both capacitive coupling and inductive coupling to achieve a negative coupling.

Another objective of the present invention is to reduce the weight of the dielectric waveguide filter.

A further objective of the present invention is to provide a negative coupling structure with the features of small volume, high performance, simple structure and easy manufacture.

To achieve the aforementioned and other objectives, the present invention provides a negative coupling structure applied in a dielectric waveguide filter and comprising a dielectric body, a plurality of tuning holes and the negative coupling structure disposed on the dielectric body, and the negative coupling structure is an elongated blind hole formed on a first surface of the dielectric body and between two adjacent tuning holes, and the tuning holes are blind holes disposed on the first surface of the dielectric body or on a second surface opposite to the first surface, and the negative coupling structure comprises: a first coupling portion, defined in the dielectric body, and serving as a bottom wall of the elongated blind hole; a second coupling portion, defined in the dielectric body, and serving as a side wall of one of the two ends of the elongated blind hole; and a common coupling portion, coupled to the first coupling portion and the second coupling portion, defined as one of the two ends of the elongated blind hole, and coupled to connecting wall of the bottom wall and the side wall.

In an embodiment of the present invention, the dielectric body comprises an inductive coupling structure penetrating through the dielectric body, and the inductive coupling structure provides an inductive coupling between the remaining two adjacent tuning holes in addition to the two tuning holes of the adjacent negative coupling structure.

In an embodiment of the present invention, the other one of the two ends of the elongated blind hole is communicated to the inductive coupling structure, and the inductive coupling structure is T-shaped.

In an embodiment of the present invention, the first coupling portion, the second coupling portion and the common coupling portion are coupled to form an L-shaped structure and surround the elongated blind hole.

In an embodiment of the present invention, the first coupling portion in the dielectric body has a bottom wall with a wall thickness equal to d1, and the dielectric body has a thickness equal to d, and $d1<d/3$. The second coupling portion in the dielectric body has a side wall with a wall thickness equal to d2 at the thinnest position, and the elongated blind hole has a length equal to d3, and $d2<(d2+d3)/3$.

In an embodiment of the present invention, the second surface of the dielectric body opposite to the elongated blind hole further comprises a symmetric groove, and the wall body of the bottom groove of the symmetric groove is also the bottom wall of the elongated blind hole, and the wall body has a first notch formed at the other one of the two ends of the elongated blind hole, and the symmetric groove is provided for shifting the bottom wall serving as the elongated blind hole of the first coupling portion towards the center of the dielectric body, and the first notch makes the length of the bottom wall of the elongated blind hole smaller than the length of the elongated blind hole, and a slot of symmetric groove is communicated to a side surface of the dielectric body, and the second coupling portion has a second notch formed at one of the two ends of the elongated blind hole, and the second notch makes the elongated blind hole to be communicated to a side surface of the dielectric body.

In an embodiment of the present invention, two ribs are protruded from the bottom wall of the elongated blind hole towards the blind hole, and a stepped rib structure is extended from a joint position between the first coupling portion and the second coupling portion.

In an embodiment of the present invention, the first coupling portion in the dielectric body has a bottom wall with a wall thickness equal to d1 at the thinnest position, and the dielectric body has a thickness equal to d, and $d1<d/3$. The second coupling portion in the dielectric body has a side wall with a wall thickness equal to d2 at the thinnest position, and the elongated blind hole has a length equal to d3, and the bottom wall of the elongated blind hole has a length equal to d4, and $d4>4(d2+d3)/5$, and $d2<(d2+d3)/3$.

In an embodiment of the present invention, the second coupling portion and the common coupling portion formed a side wall one of the two ends of the elongated blind hole with a length greater than ⅓ of the thickness of the dielectric body.

Therefore, the negative coupling structure applied in a dielectric waveguide filter in accordance with the present invention uses the elongated blind hole formed on the first surface of the dielectric body to create the negative coupling structure, and the first surface or the second surface of the dielectric body is provided to form the plurality of tuning holes, so that both capacitive coupling and inductive coupling can be achieved by designing each coupling portion in the dielectric body in a corresponding shape, and the negative coupling can be achieved. This invention has the effects of reducing the weight and the volume of the dielectric waveguide filter, and providing good performance, simple structure, and easy manufacture.

DESCRIPTION OF THE PREFERRED EMBODIMENTS

The aforementioned and other objects, characteristics and advantages of the present invention will become apparent with the detailed description of the preferred embodiments and the illustration of related drawings as follows.

In this specification, the terms "comprising, including, and having" or any other similar semantics are not limited to the elements listed in this specification only, but may include other elements usually inherent from the part, structure, position or area not specifically listed in the specification.

In this specification, the term "first" or "second" is similar to an ordinal word used to distinguish or refer to associated a same or similar part or structure, and it is not necessary to imply the sequence of these parts, structures, portions, or areas in a space. It is noteworthy that the ordinal words are interchangeable in a certain situation or configuration without affecting the implementation of the invention.

Figure 1:
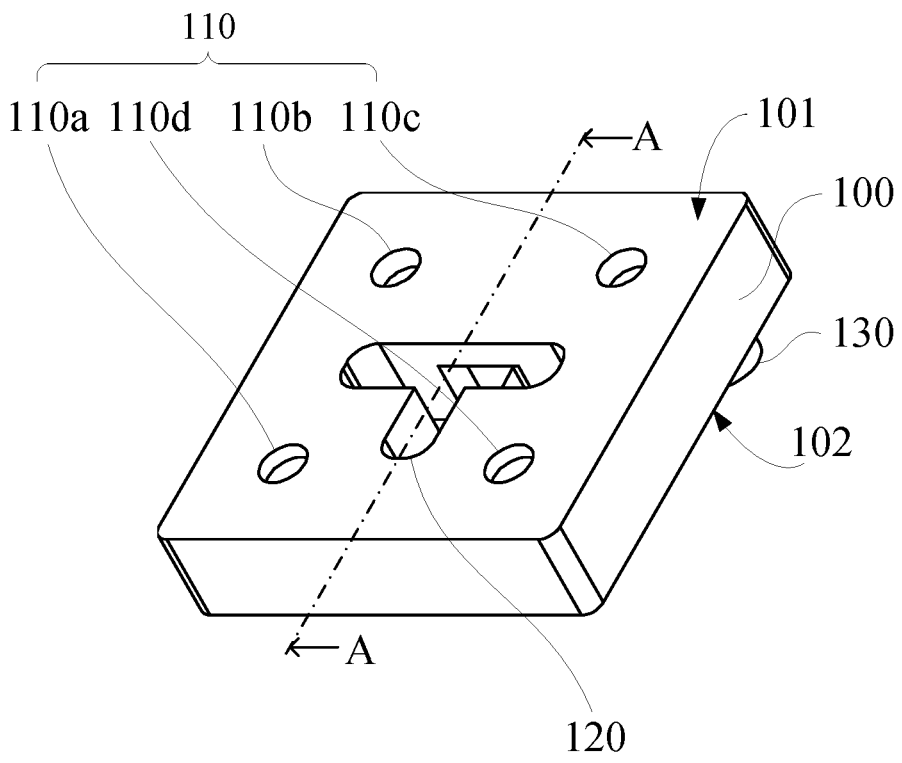
FIG. 1 is a perspective view of a dielectric waveguide filter in accordance with an embodiment of the present invention.
Figure 2:
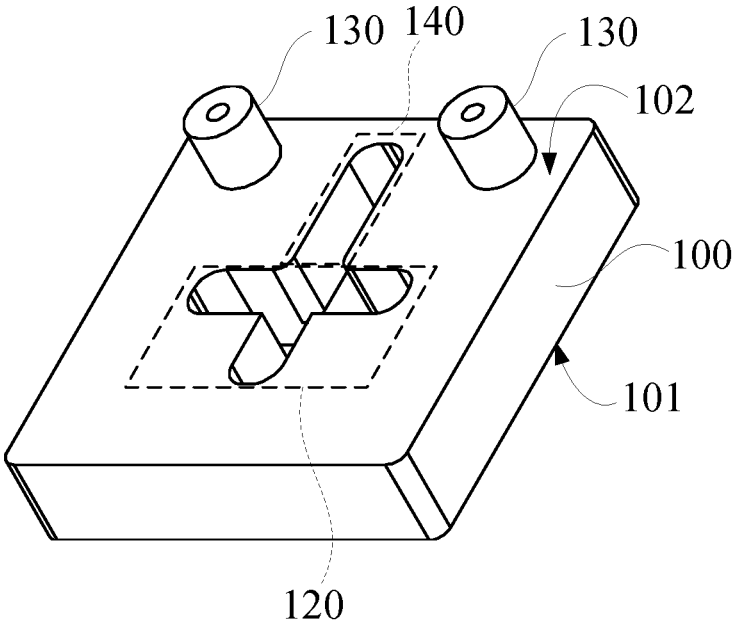
FIG. 2 is another perspective view of the dielectric waveguide filter in accordance with an embodiment of the present invention (viewing from another angle)

With reference to FIGS. 1 and 2 for two perspective views of a dielectric waveguide filter in accordance with an embodiment of the present invention viewing at different angles respectively, the dielectric waveguide filter comprises a dielectric body 100, and a plurality of tuning holes 110 formed on an upper surface of the dielectric body 100 for tuning the resonant frequency. The tuning holes 110 are blind holes not limited to any particular shape. In this embodiment, a circular blind hole is used for illustration. In addition, the dielectric body 100 comprises an inductive coupling structure 120 penetrating through the dielectric body 100, wherein the inductive coupling structure 120 of this embodiment is a T-shaped structure.

In FIGS. 1 and 2, the dielectric body 100 has a first tuning hole 110*a*, a second tuning hole 110*b*, a third tuning hole 110*c*, and a fourth tuning hole 110*d* formed on an upper surface 101 thereof. The first tuning hole 110*a* and the second tuning holes 110*b*, as well as the third tuning hole 110*c* and the fourth tuning hole 110*d* form an inductive coupling therebetween by the inductive coupling structure 120. With the design of each tuning hole, the frequency of the signals in the dielectric body 100 can be tuned, and a signal input/output portion 130 is provided for transmitting or receiving a signal. In FIG. 2, one of the two signal input/output portions 130 (which is an output terminal) is for outputting signals, and the other one (which is an input terminal) is for receiving signals.

In an embodiment of the present invention, a negative coupling structure 140 is installed on a lower surface 102 of the dielectric body 100. The negative coupling structure 140 is installed between two adjacent tuning holes. In other words, the negative coupling structure 140 is disposed between the second tuning hole 110*b* and the third tuning hole 110*c*. The negative coupling structure 140 is an elongated blind hole having an opening disposed on the lower surface 102 of the dielectric body 100 and on a different surface of the dielectric body 100 having the openings of the tuning holes 110.

A surface of the dielectric body 100 is electroplated with a metal conductive layer (such as a silver plated), and each of the blind holes and an inner wall of each tuning hole is also electroplated with the metal conductive layer. The depth of the elongated blind hole of the negative coupling structure 140 depends on the required coupling. With the structural configuration in accordance with this embodiment of the present invention, a better coupling effect can be achieved.

Figure 3:
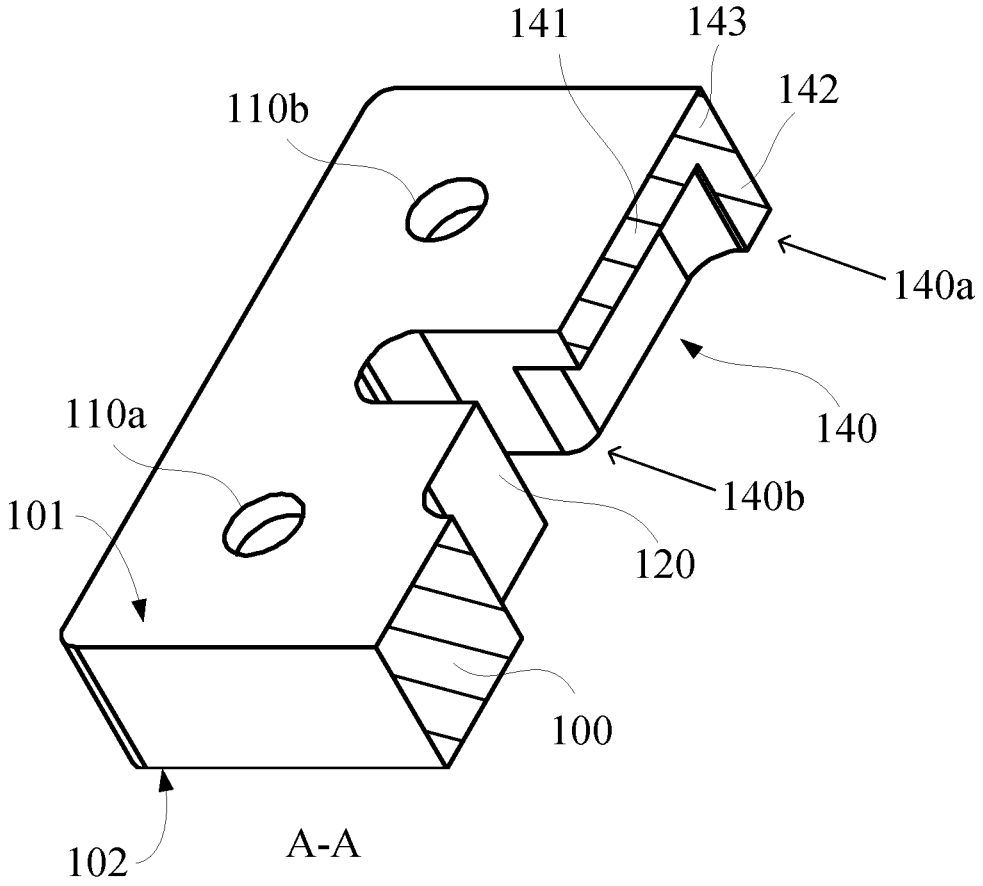
FIG. 3 is a cross-sectional view of Section A-A of FIG. 1.
Figure 4:
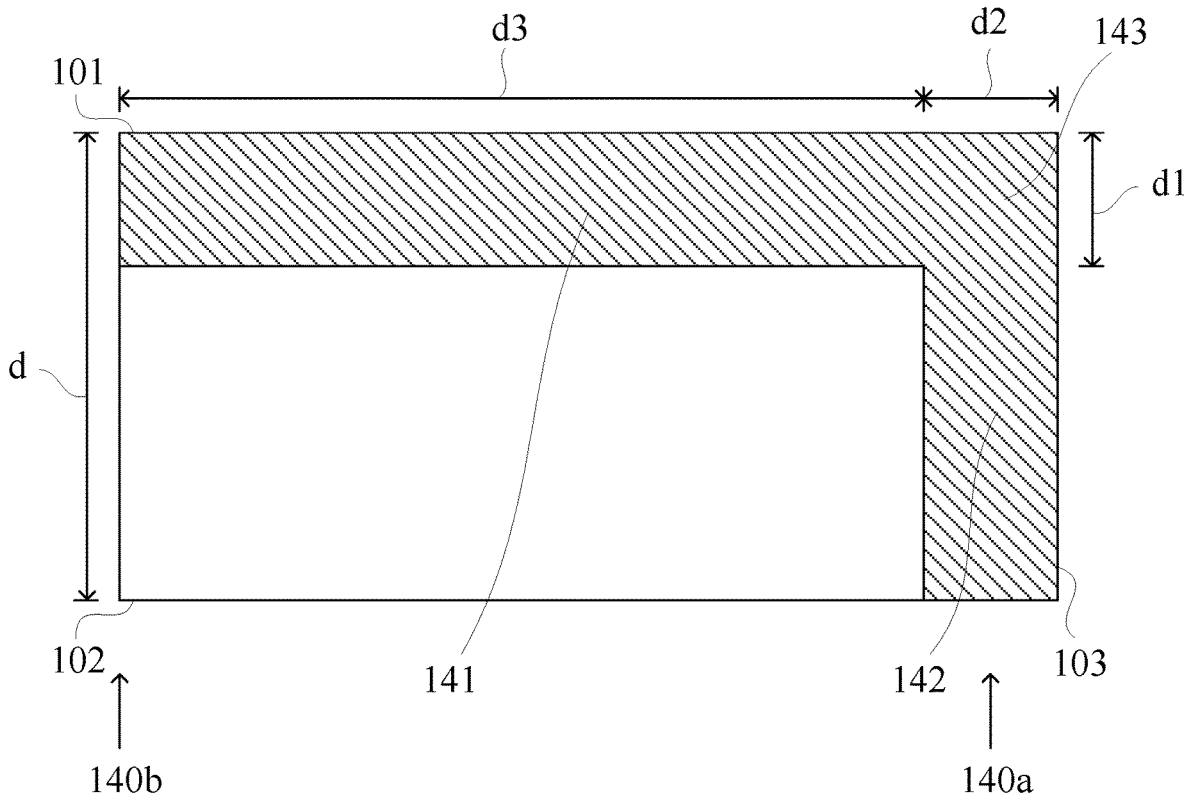
FIG. 4 is a planar blowup view of a negative coupling structure shown in FIG. 3.

With reference to FIGS. 3 and 4 for the cross-section view of Section A-A of FIG. 1 and the planar blowup view of a negative coupling structure in accordance with an embodiment of the present invention respectively, the negative coupling structure 140 comprises: a first coupling portion 141, a second coupling portion 142 and a common coupling portion 143. The first coupling portion 141, the second coupling portion 142 and the common coupling portion 143 are coupled to form an L-shaped structure and surround a part of the periphery of the elongated blind hole.

The first coupling portion 141 is defined in the dielectric body 100 and serves as a bottom wall of the elongated blind hole (or the wall body at the bottom of the elongated blind hole). The second coupling portion 142 is defined in the dielectric body 100 and serves as a side wall at one end 140*a* of the two ends 140*a*, 140*b* of the elongated blind hole, which is a wall body of the elongated blind hole. The common coupling portion 143 is coupled to the first coupling portion 141 and the second coupling portion 142, and the common coupling portion 143 is defined at the one end 140*a* of the two ends 140*a*, 140*b* of the elongated blind hole and serves as a connecting wall for coupling the bottom wall and the side wall of the elongated blind hole, wherein an outer wall of the connecting wall comprises an upper surface 101 and a side surface 103 of the dielectric body 100. In addition, the other end 140*b* of the two ends 140*a*, 140*b* of the negative coupling structure 140 is communicated to the inductive coupling structure 120 (as shown in FIG. 2).

In an embodiment of the present invention, the first coupling portion 141 and the common coupling portion 143 of the negative coupling structure in the dielectric waveguide filter are provided for producing a capacitive coupling effect and serving as a capacitive coupling area. The second coupling portion 142 and the common coupling portion 143 of the negative coupling structure in the dielectric waveguide filter are provided for producing an inductive coupling effect and serving as an inductive coupling area.

The capacitive coupling drives the coupling in the cavity of the dielectric body 100 to produce a capacitive effect, so that an offsetting effect between a signal passing through the capacitive coupling area and a signal not passing through the capacitive coupling area (such as the signal passing through the inductive coupling area) is produced after phase superimposition, so as to achieve the effect of transmission zero and improve the suppression effect of the filter.

In an embodiment of the invention as shown in FIGS. 1 to 4, four tuning holes 110*a*~110*d* are provided, wherein the inductive coupling structure 120 is used to provide an inductive coupling for the remaining two adjacent tuning holes (between the first tuning hole 110*a* and the second tuning hole 110*b*, and between the third tuning hole 110*c* and the fourth tuning hole 110*d*) in addition to the two tuning holes (110*b*, 110*c*) adjacent to the negative coupling structure 140.

In FIG. 4, the coupling effect is further improved, and when the bottom wall of the first coupling portion 141 in the dielectric body 100 has a wall thickness equal to d1, and the dielectric body has a thickness equal to d, d1 can be smaller than d/3. When the side wall of the second coupling portion 142 in the dielectric body 100 has a wall thickness equal to d2 at the thinnest position and the elongated blind hole has a length equal to d3, d2 can be smaller than (d2+d3)/3. Therefore, the negative coupling structure 140 in the dielectric waveguide filter can have a coupling window designed with a specific shape, so that both capacitive coupling and inductive coupling can be achieved. In addition, adjustments can be made according to the aforementioned proportion, so that the negative coupling structure 140 can produce a better negative coupling effect.

Figure 5:
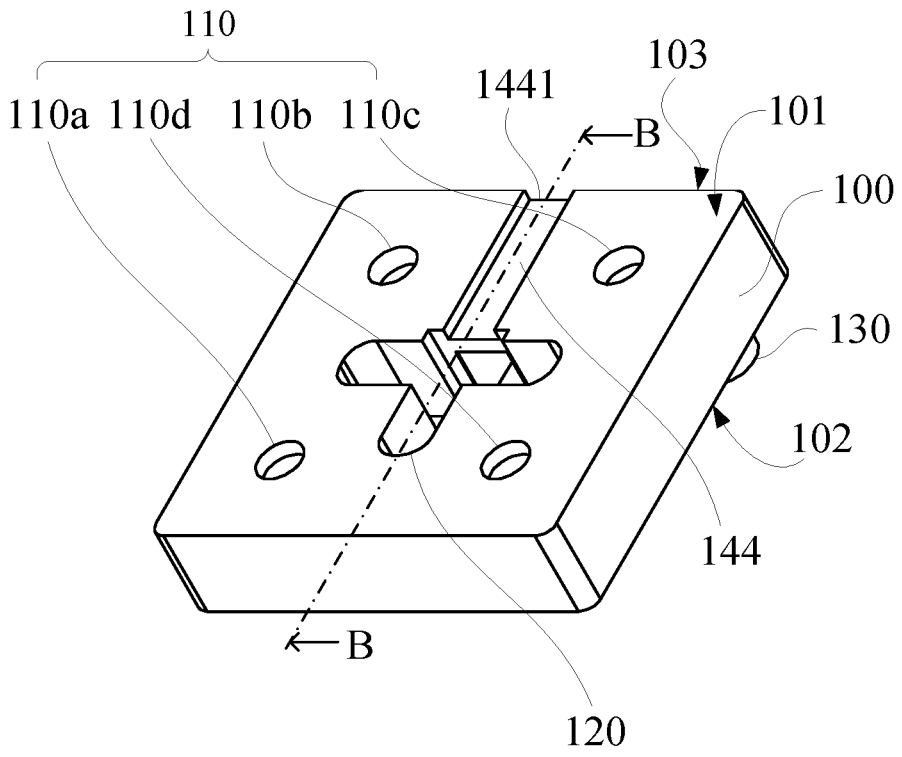
FIG. 5 is a perspective view of a dielectric waveguide filter in accordance with another embodiment of the present invention.
Figure 6:
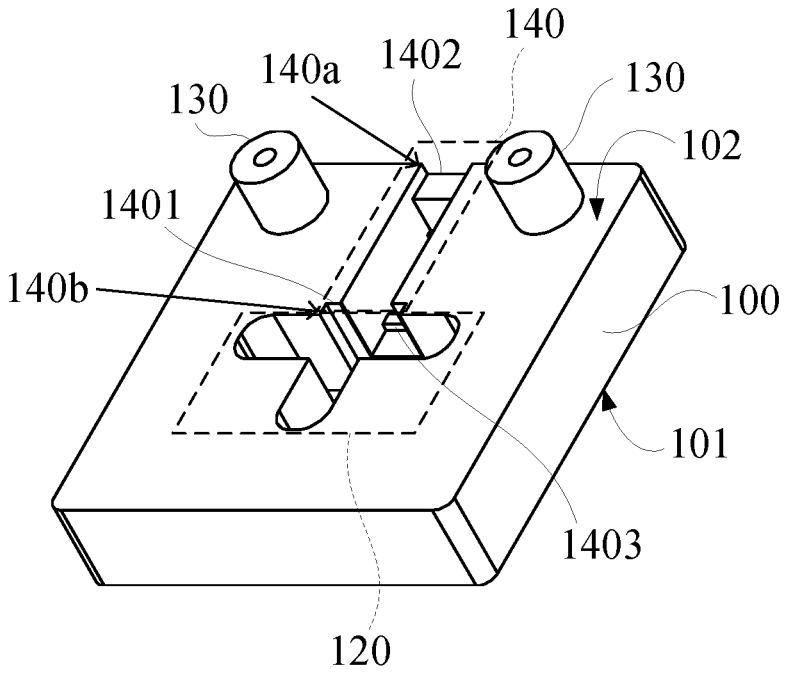
FIG. 6 is another perspective view of the dielectric waveguide filter of FIG. 5 (viewing from another end)
Figure 7:
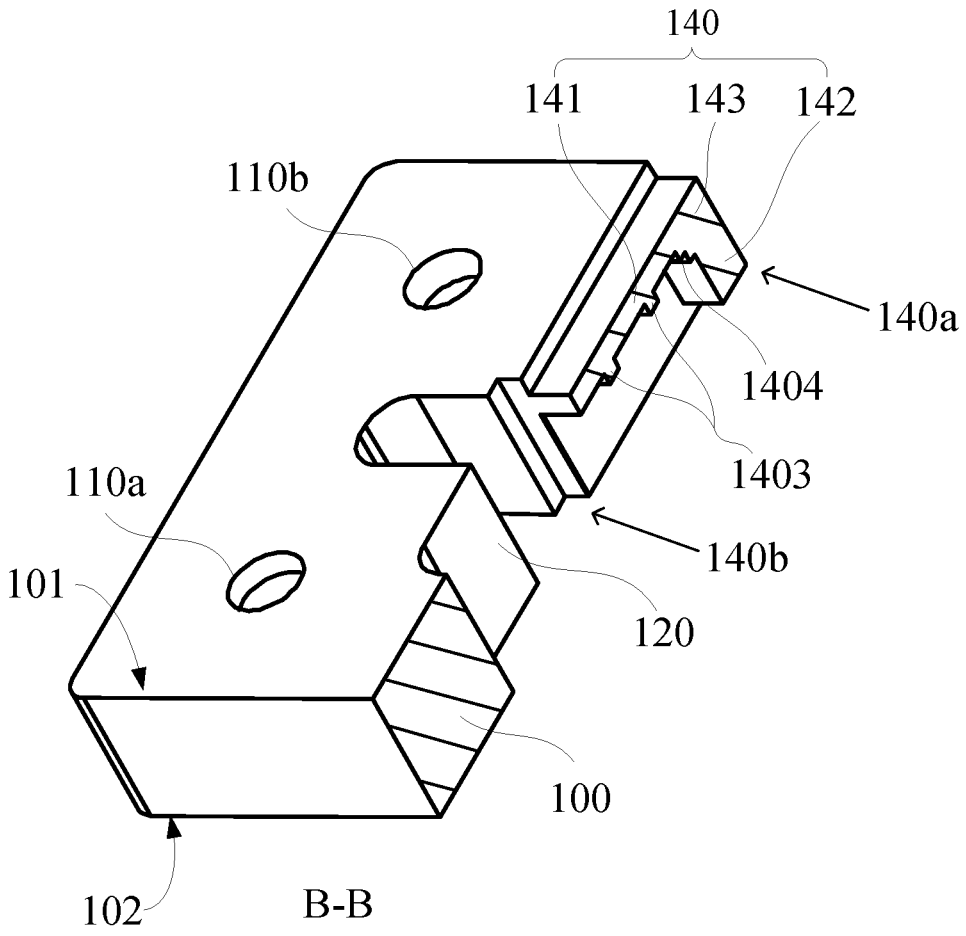
FIG. 7 is a cross-sectional view of Section B-B of FIG. 5.

With reference to FIGS. 5 to 8 for two perspective views of a dielectric waveguide filter, the cross-sectional view of Section B-B of FIG. 5, and the planar blowup view of a negative coupling structure in accordance with another embodiment of the present invention respectively, this embodiment also has the negative coupling structure of the previous embodiment, and further uses less dielectric materials to build the negative coupling structure.

Figure 8:
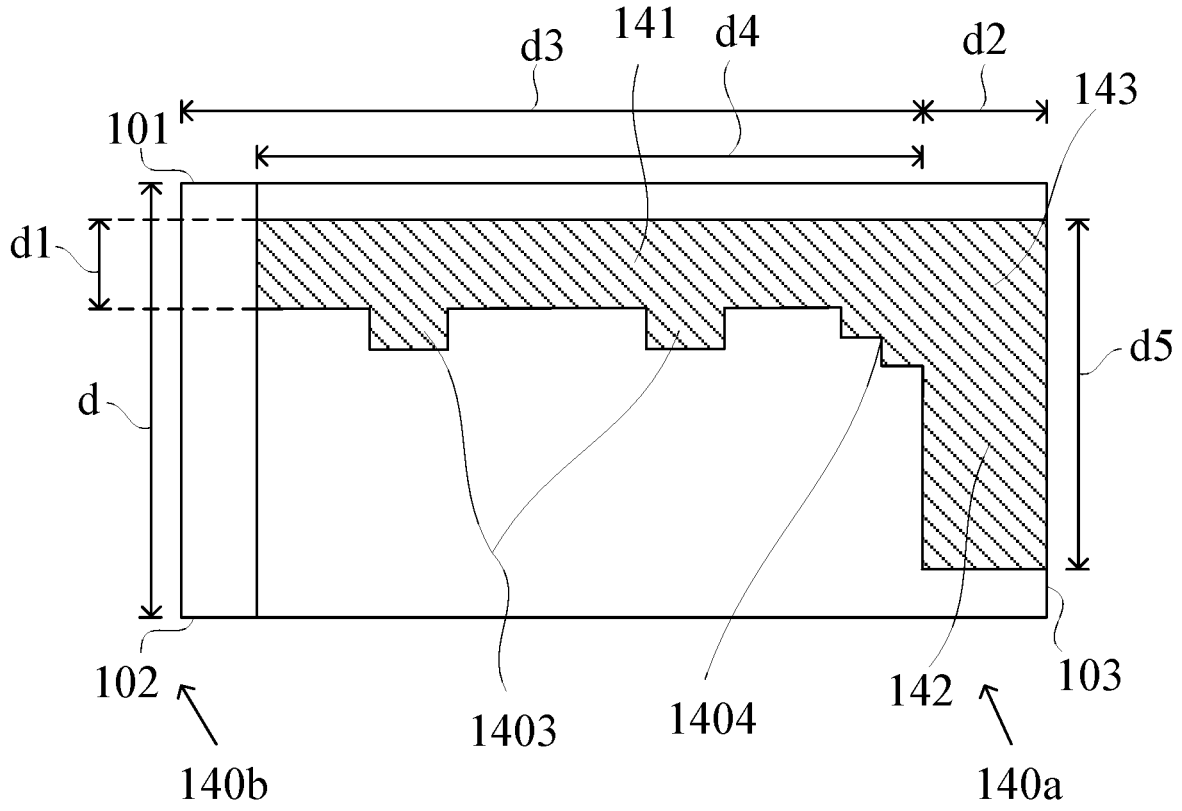
FIG. 8 is a planar blowup view of a negative coupling structure shown in FIG. 7.

In FIG. 8, the negative coupling structure of this embodiment further comprises a symmetric groove 144 formed on an upper surface 101 of the dielectric body 100 and disposed on a surface opposite to that having the elongated blind hole of the negative coupling structure 140. The wall body at the bottom of the symmetric groove 144 is also the wall body of the bottom wall of the elongated blind hole. In addition, the wall body has a first notch 1401 formed at the other end 140*b* of the two ends (140*a*, 140*b*) of the elongated blind hole. The symmetric groove 144 is provided for driving the bottom wall of the elongated blind hole of the first coupling portion 141 to shift towards the center of the dielectric body 100. In other words, the bottom wall of the elongated blind hole can be closer to the center of the dielectric body 100, and the bottom wall of the elongated blind hole can be thinner.

Based on the configuration of the first notch 1401, the length d4 of the bottom wall of the elongated blind hole can be smaller than the length d3 of the elongated blind hole. The slot 1441 of the symmetric groove 144 is communicated to a side surface 103 of the dielectric body 100. The side wall of the second coupling portion 142 at one end 140*a* of the two ends 140*a*, 140*b* of the elongated blind hole has a second notch 1402, and the second notch 1402 allows the elongated blind hole to be communicated to the side surface 103 of the dielectric body 100.

Further, two ribs 1403 are protruded from the bottom wall of the elongated blind hole towards the interior of the blind hole, and the two ribs 1403 are basically extended in a direction perpendicular to the elongated blind hole to cross the bottom of the elongated blind hole. In addition, a stepped rib structure 1404 is disposed at a joint position between the first coupling portion 141 and the second coupling portion 142 and inside the elongated blind hole.

In FIG. 8, when the bottom wall of the first coupling portion 141 in the dielectric body 100 has a wall thickness equal to d1 at the thinnest position, and the dielectric body 100 has a thickness equal to d, d1 can be smaller than d/3. When the side wall of the second coupling portion 142 in the dielectric body 100 has a wall thickness equal to d2 at the thinnest position and the elongated blind hole has a length equal to d3, and the bottom wall of the elongated blind hole has a length equal to d4, d4 can be greater than 4(d2+d3)/5, and d2 can also be smaller than (d2+d3)/3. In addition, the side wall of the second coupling portion 142 and the common coupling portion 143 at one end 140*a* of the two ends 140*a*, 140*b* of the elongated blind hole has a length d5 greater than 3/4 of the thickness of the dielectric body 100. In other words, d5>3 d/4.

In another embodiment relative to the embodiment as shown in FIGS. 1 to 8, the negative coupling structure 140 can be installed on the upper surface 101 of the dielectric body 100, and the tuning holes 110 can be formed on the upper surface 101 or the lower surface 102 of the dielectric body 100. When the tuning holes 110 are formed on the lower surface 102 of the dielectric body 100, the signal input/output portion 130 is disposed on the upper surface 101.

In other words, the negative coupling structure 140 is an elongated blind hole formed on the first surface of the dielectric body 100. It is noteworthy that the dielectric body 100 is installed between two adjacent tuning holes 110, regardless of whether or not the negative coupling structure 140 is on the same side with the tuning holes 110. Therefore, the tuning holes 110 are blind holes formed on the first surface of the dielectric body 100, or on the second surface opposite to the first surface. The first surface can be the upper surface 101 or the lower surface 102, and the second surface can be the lower surface 102 or the upper surface 101. In conclusion, the negative coupling structure 140 can be installed on the upper surface 101 or the lower surface 102 of the dielectric body 100.

In summation of the description above, the dielectric waveguide filter as disclosed in the embodiment of the present invention has the first coupling portion formed on the bottom wall of the elongated blind hole, the second coupling portion formed on a side wall of the elongated blind hole, the common coupling portion for coupling the bottom wall and the side wall, and the negative coupling structure in a specific shape defined in the dielectric body, so as to have both capacitive coupling and inductive coupling to achieve the negative coupling, and the invention also has the effects of reducing the weight and volume, improving the performance, and providing a simple structure and an easy manufacture of the dielectric waveguide filter.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A negative coupling structure applied in a dielectric waveguide filter, comprising: a dielectric body, a plurality of tuning holes and the negative coupling structure disposed on the dielectric body, and the negative coupling structure being an elongated blind hole formed on a first surface of the dielectric body, and the negative coupling structure being formed between two adjacent tuning holes of the plurality of tuning holes, and the plurality of tuning holes being blind holes disposed on the first surface of the dielectric body or on a second surface opposite to the first surface, and the negative coupling structure comprising:

a first coupling portion, defined in the dielectric body, and serving as a bottom wall of the elongated blind hole;

a second coupling portion, defined in the dielectric body, and serving as a side wall of one of the two ends of the elongated blind hole; and a common coupling portion, coupled to the first coupling portion and the second coupling portion, defined as one of the two ends of the elongated blind hole, and coupled to connecting wall of the bottom wall and the side wall.

2. The negative coupling structure as claimed in claim 1, wherein the dielectric body comprises an inductive coupling structure penetrating through the dielectric body, and the inductive coupling structure provides an inductive coupling between two tuning holes having adjacent relationship in the plurality of tuning holes, except for the two adjacent tuning holes adjacent to the negative coupling structure.

3. The negative coupling structure as claimed in claim 2, wherein the other one of the two ends of the elongated blind hole is communicated to the inductive coupling structure.

4. The negative coupling structure as claimed in claim 3, wherein the inductive coupling structure is T-shaped.

5. The negative coupling structure as claimed in claim 2, wherein the first coupling portion, the second coupling portion and the common coupling portion are coupled to form an L-shaped structure and surround the elongated blind hole.

6. The negative coupling structure as claimed in claim 1, wherein the first coupling portion in the dielectric body has a bottom wall with a wall thickness equal to d1, and the dielectric body has a thickness equal to d, and $d1<d/3$.

7. The negative coupling structure as claimed in claim 6, wherein the second coupling portion in the dielectric body has a side wall with a wall thickness equal to d2 at the thinnest position, and the elongated blind hole has a length equal to d3, and $d2<(d2+d3)/3$.

* * * * *